US010500872B2

(12) United States Patent
Liu et al.

(10) Patent No.: US 10,500,872 B2
(45) Date of Patent: Dec. 10, 2019

(54) PRINTER AND DRYER FOR DRYING IMAGES ON COATED SUBSTRATES IN AQUEOUS INK PRINTERS

(71) Applicant: Xerox Corporation, Norwalk, CT (US)

(72) Inventors: Chu-Heng Liu, Penfield, NY (US); Douglas K. Herrmann, Webster, NY (US); Paul J. McConville, Webster, NY (US); Jason M. LeFevre, Penfield, NY (US); Seemit Praharaj, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/934,154

(22) Filed: Mar. 23, 2018

(65) Prior Publication Data

US 2019/0291466 A1 Sep. 26, 2019

(51) Int. Cl.

| | |
|---|---|
| ***B41J 11/00*** | (2006.01) |
| ***B41J 11/04*** | (2006.01) |
| ***B41J 3/54*** | (2006.01) |

(52) U.S. Cl.

CPC ..... *B41J 11/002* (2013.01); *B41J 3/54* (2013.01); *B41J 11/04* (2013.01)

(58) Field of Classification Search

CPC ..... B41J 11/0015; B41J 11/002

See application file for complete search history.

(56) References Cited

U.S. PATENT DOCUMENTS

| | | | | |
|---|---|---|---|---|
| 2,022,593 | A * | 11/1935 | Fuykers | B41F 23/0426 101/424.1 |
| 5,371,531 | A | 12/1994 | Rezanka et al. | |
| 6,076,921 | A | 6/2000 | Rezanka et al. | |
| 6,132,038 | A | 10/2000 | Szlucha | |
| 6,428,160 | B2 | 8/2002 | Roy et al. | |
| 6,799,759 | B1 | 10/2004 | McNamara et al. | |
| 2004/0189769 | A1* | 9/2004 | Wilbur | B41J 11/002 347/102 |
| 2007/0019050 | A1* | 1/2007 | Lim | B41J 11/002 347/102 |
| 2008/0204535 | A1* | 8/2008 | Sakagami | B41J 11/002 347/102 |
| 2011/0050824 | A1* | 3/2011 | Toya | B41J 11/002 347/102 |
| 2011/0267393 | A1* | 11/2011 | Okamoto | B41J 11/002 347/14 |
| 2017/0087874 | A1* | 3/2017 | Maida | B41J 11/002 |

* cited by examiner

*Primary Examiner* — Shelby L Fidler

(74) *Attorney, Agent, or Firm* — Maginot Moore & Beck LLP

(57) ABSTRACT

An aqueous ink printer includes two drying stages that enable coated substrates to be printed with aqueous ink images. The first drying stage dries substrates uniformly in the cross-process direction and the second drying stage dries substrates non-uniformly in the cross-process direction to enable only predetermined portions of the printed substrates to be dried. The predetermined portions of the printed substrates are aligned in a process direction with nip rollers or other printer components that engage the substrates after the substrates exit the second drying stage.

8 Claims, 3 Drawing Sheets

PRINTER AND DRYER FOR DRYING IMAGES ON COATED SUBSTRATES IN AQUEOUS INK PRINTERS

TECHNICAL FIELD

This disclosure relates generally to aqueous ink printing systems, and more particularly, to drying systems in such printers.

BACKGROUND

Known aqueous ink printing systems print images on uncoated substrates. Whether an image is printed directly onto a substrate or transferred from a blanket configured about an intermediate transfer member, once the image is on the substrate, the water and other solvents in the ink must be substantially removed from the surface to fix the image to the substrate. A dryer is typically positioned after the transfer of the image from the blanket or after the image has been printed on the substrate for removal of the water and solvents. To enable relatively high speed operation of the printer, the dryer uniformly heats the entire substrate and ink to temperatures that typically reach 100° C. Uncoated substrates generally require exposure to the high temperatures generated by the dryer for a relatively brief period of time, such as a range of about 500 to about 750 msec, for effective removal of the liquids from the surfaces of the substrates.

Coated substrates are desired for aqueous ink images. The coated substrates are typically used for high quality image brochures and magazine covers. These coated substrates, however, exacerbate the challenges involved with removing water from the ink images as an insufficient amount of water and solvents is removed from the ink image by currently known dryers. One approach to addressing the inadequacy of known dryers is to add one or more uniformly drying stages after the first dryer that repeat the uniform drying performed by the first dryer. This approach suffers from a substantial lengthening of the footprint of the printer and an increase in the energy consumed by the printer from the addition of the other uniform drying stages. Also, adding uniform drying stages to an aqueous ink printing system increases the complexity of the system and can impact reliability of the system. Another approach is to increase the temperature generated by a uniform drying stage; however, an upper limit exists for the temperature generated by the uniform drying stage. At some point, the temperature can reach a level that degrades some substrates or the higher temperature of the substrates can result in the output stack of substrates retaining too much heat for comfortable retrieval of the printed documents. Developing drying devices and methods that enable ink images on coated papers to be efficiently processed without significantly increasing the time for processing the images, the footprint of the printer, the complexity of the printing system, or the temperatures to which the substrates are raised would be beneficial.

SUMMARY

A new aqueous ink printing system includes a non-uniform drying stage that enables efficient drying of aqueous ink images in predetermined areas without appreciable additional complexity or significant increases in drying temperatures. The printing system includes at least one printhead configured to eject drops of an aqueous ink, a substrate transport system configured to move substrates past the at least one printhead to enable the at least one printhead to eject drops of the aqueous ink onto the substrates to form aqueous ink images on the substrates, a first drying stage configured to dry the substrates uniformly after the at least one printhead has formed aqueous ink images on the substrates, and a second drying stage positioned to dry the substrates non-uniformly after the substrates have passed through the first drying stage, the second drying stage being configured to direct drying only at predetermined portions of the substrates to enable the predetermined portions of the substrates to dry more thoroughly than remaining portions of the substrates.

A new non-uniform drying stage for an aqueous ink printing system enables efficient drying of aqueous ink images in predetermined areas without appreciable additional complexity or significant increases in drying temperatures. The non-uniform drying stage includes a plurality of members, and a plurality of drying elements mounted to the members, the drying elements being configured to direct drying produced by the drying elements to only predetermined portions of the substrates that align in a process direction through the drying stage.

BRIEF DESCRIPTION OF THE DRAWINGS

The foregoing aspects and other features of an aqueous ink printing system that includes a non-uniform drying system that enables efficient drying of aqueous ink images in predetermined areas without appreciable additional complexity or significant increases in drying temperatures are explained in the following description, taken in connection with the accompanying drawings.

DETAILED DESCRIPTION

Figure 1:
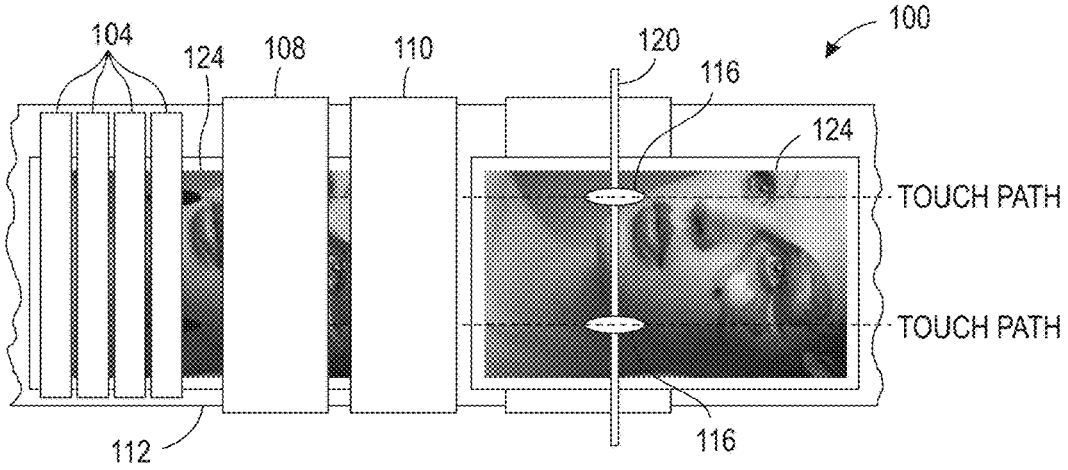
FIG. 1 is a block diagram of an aqueous ink printing system that enables efficient drying of aqueous ink images without appreciable additional complexity or significant increases in drying temperatures.

For a general understanding of the present embodiments, reference is made to the drawings. In the drawings, like reference numerals have been used throughout to designate like elements.

FIG. 1 depicts a block diagram of an aqueous printing system 100 that is configured to print images on coated paper without the energy consumption and elevated substrate temperatures that arise from additional conventional dryers. The system 100 includes one or more arrays 104 of printheads, a first drying stage 108, a second drying stage 110, a transport belt 112, and a pair of nip rollers 116 mounted about a member 120 that extends in a cross-process direction across the substrates 124 carried by the transport belt 112. While the system 100 shown in FIG. 1 uses separate dryers to provide the two drying stages, the directed drying of the second dryer 110 can be included as an additional drying stage in the first dryer 108 that follows the initial drying performed by the first drying stage as described below. As used in this document, the term "drying stage" refers to a configuration of drying components that can be operated to dry a printed substrate. The words "dry" and "drying" as used in this document means using a form of energy to evaporate a liquid or a solvent that can be directed along a predetermined path. The transport belt 112 is an endless belt entrained about two or more rollers, one of which is driven by an actuator to rotate the belt about the rollers. Additional structure in the belt is discussed in more detail below. As used in this document, the term "cross-process direction" refers to the direction perpendicular to the direction of substrate movement past the printheads and the drying stages that also lies in the plane of the substrate. The term "process direction" as used in this document refers to the direction of substrate movement past the printheads and the drying stages that also lies in the plane of the substrate.

The printhead arrays 104 are operated in a known manner to eject drops of aqueous ink onto the substrates passing by them to form ink images on the substrates. The first drying stage 108 is configured as previously known dryers in aqueous ink printing systems to heat the substrates uniformly to a temperature that removes enough of the water from the aqueous ink on coated substrates that the ink begins to become sticky. This sticky ink, however, can be problematic in two situations. One situation occurs when the printed substrates are stacked on one another as occurs in the output tray of a printer. In this situation, each ink image underlies the unprinted surface of the substrate covering it. Sufficiently drying the sticky ink image so it does not offset to the unprinted surface of the overlying substrate is known as meeting the stacking criterion. The other situation occurs when the sticky ink image encounters a surface that presses against a portion of the ink image. For example, as a printed substrate is carried by the transport belt through a printer to the output tray, it encounters nip rollers that help hold the substrates on the belt. Sufficiently drying the sticky ink so it does not adhere to the nip rollers is known as meeting the touch criterion. Meeting the touch criteria is more difficult than meeting the stacking criteria because the pressure on the ink under stacking conditions is much lower than the pressure under the nip rollers. Furthermore, for stacking, the substrates are further downstream of the printheads when they enter the output tray so they have had more time to enable the solvents in the ink to be absorbed by the substrates and for the ambient air in the printer to evaporate water from the inks. Requiring the entire sticky ink image to meet the touch criterion would necessitate additional uniform drying of the entire printed images on the substrates before the images encounter a nip roller or other printer components that press against the images.

The printer 100 takes advantage of the differences between the touch criterion and the stacking criterion by configuring one or more non-uniformly drying stages 110 to dry more intensely those areas of the printed image that contact a nip roller or other component once the image leaves the non-uniformly drying stage or stages. In one embodiment, the non-uniformly drying stage 110 is configured with infrared radiators that direct infrared radiation to the predetermined areas of the substrates along the cross-process direction that correspond with the locations of the nip rollers 116. These areas are identified in FIG. 1 as being in one of the touch paths. In another embodiment, microwave radiators are configured to direct microwave radiation to the predetermined substrate areas that correspond with the nip rollers 116. In other embodiments, a convection heater or heating lamp can be used and the heated air produced by the heater is directed by a blower toward the predetermined areas of the image corresponding to the nip rollers, and in others, lasers can be oriented to direct a drying light at the predetermined areas of the image corresponding to the nip rollers. In yet other embodiments, a fan or other source of positive air flow can be used to direct air flow to the predetermined areas of the image corresponding to the nip rollers. Thus, the non-uniformly drying stage 110 dries the substrates 124 more intensely in the predetermined areas where the ink images are touched by rollers downstream of the non-uniformly drying stage or stages so they meet the touch criterion before encountering any components that press against those areas of the image. Additionally, the remaining areas of the substrates continue to dry so they reach the stacking criterion prior to reaching the output tray. Consequently, the temperature of the substrates are not elevated to a level that degrades the quality of the paper or adds significant complexity to the printer 100.

Figure 2A:
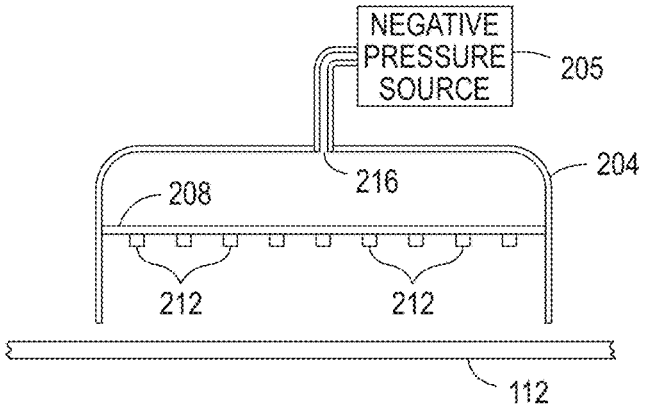
FIG. 2A is a side view of one embodiment of a drying stage that can be used in the printer of FIG. 1.
Figure 2B:
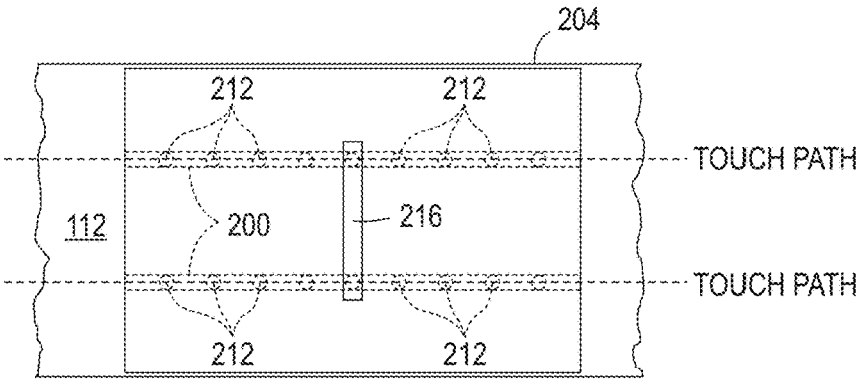
FIG. 2B is a top view of the drying stage shown in FIG. 2A.

A side view of one embodiment of a non-uniformly drying stage that can be used in the printer of FIG. 1 is shown in FIG. 2A. The non-uniformly drying stage includes a housing 204, a plurality of members 208, and drying elements 212 mounted to the members 208. The housing 204 encloses a volume of air and has an opening that communicates with the space adjacent to the substrates as they pass the housing 204. The members 208 extend across the housing 204 in a direction that is parallel to the process direction of the substrates passing by the housing as can best be seen in the top view of FIG. 2B. Mounted along the members 208 are drying elements 212. As noted above, these drying elements can be infrared radiators, microwave radiators, heat lamps, convection heaters, air blowers, and the like. For embodiments of the drying elements implemented with heat lamps or convection heaters, a source of pressurized air is included to direct the heat produced by the drying elements toward the predetermined areas of the substrates that correspond to the positions of the nip rollers. Housing 204 can also include a vent opening 216 and a source of negative pressure 205 can be connected to the vent opening to pull evaporated water and solvent from the air within the volume of the housing 204. The housing 204 helps hold heated or dry air generated by the drying elements to help dry the areas of the ink image surrounding the predetermined areas corresponding to the nip rollers. This drying, while not as intense as the drying directed to the predetermined areas corresponding to the nip rollers, helps the remaining areas of the ink image meet the stacking criterion. When the substrates move past the non-uniformly drying stage, the predetermined areas of the ink image that engage the nip rollers meet the touch criterion, while the remaining areas meet or nearly meet the stacking criterion.

Figure 3A:
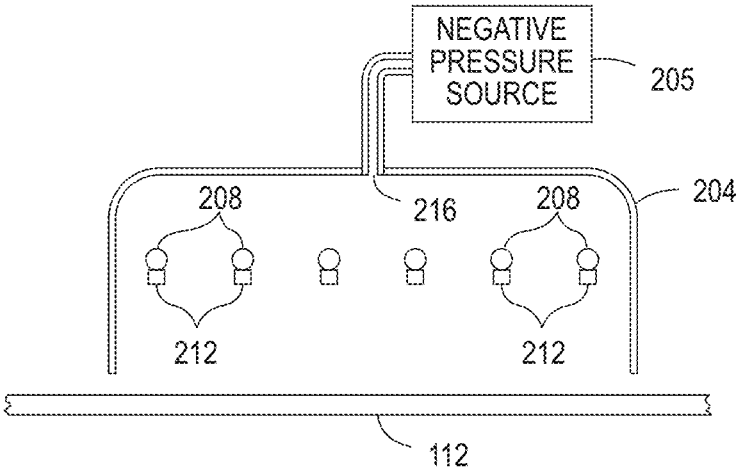
FIG. 3A is a side view of another embodiment of a drying stage that can be used in the printer of FIG. 1.
Figure 3B:
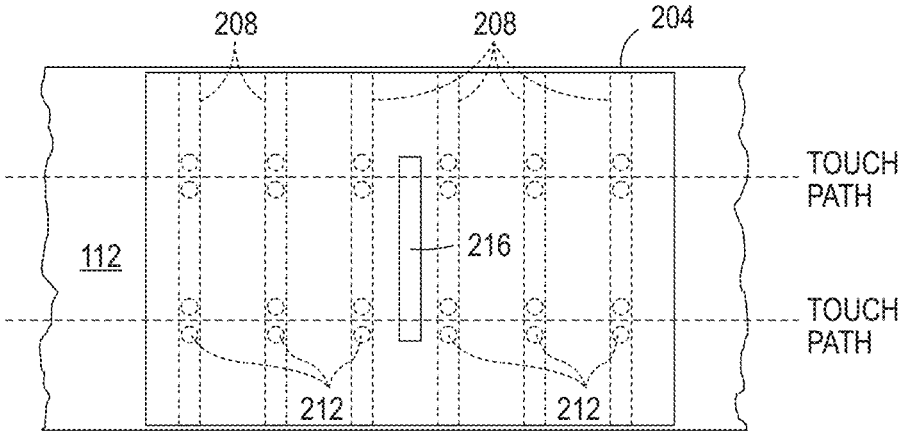
FIG. 3B is a top view of the drying stage shown in FIG. 3A.

A side view of an alternative embodiment of a non-uniformly drying stage that can be used in the printer of FIG. 1 is shown in FIG. 3A. In this embodiment, a plurality of members 208 extend across the housing 204 in a direction that is parallel to the cross-process direction of the substrates passing by the housing as can best be viewed in FIG. 3B. Mounted at predetermined intervals along the members are drying elements 212. The positioning of the drying elements corresponds with the predetermined areas of the substrates that encounter the nip rollers after leaving one or more non-uniform drying stages. As noted above, these drying elements can be infrared radiators, microwave radiators, heat lamps, convection heaters, air blowers, and the like. Both the embodiment shown in FIG. 2A and 2B and the embodiment shown in FIG. 3A and 3B, produce a contiguous line of drying in the process direction in the predetermined areas of the substrates that are touched by the nip rollers, while the remaining areas of the substrates are subjected to less intense drying.

Figure 4:
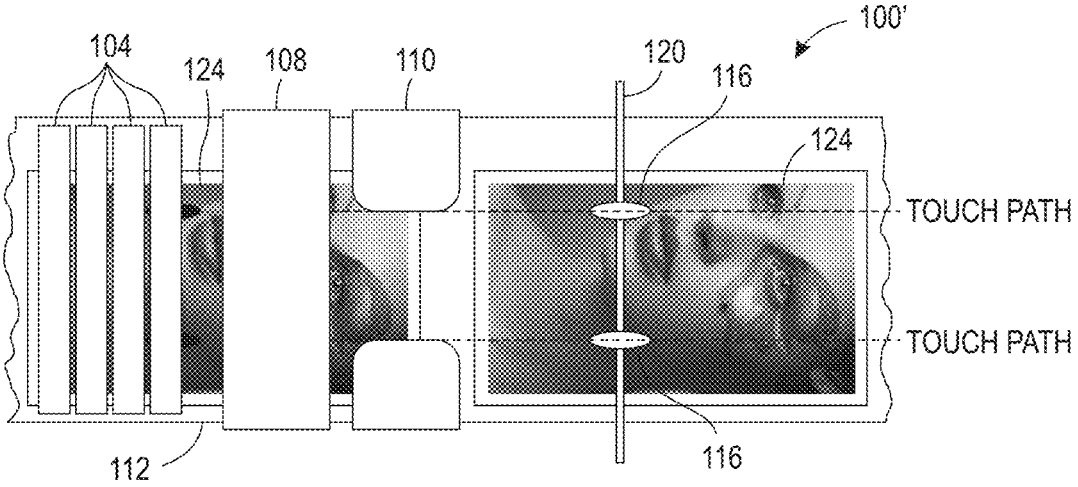
FIG. 4 is a top view of an alternative embodiment of the printer shown in FIG. 1 that does not have a housing for the drying stage that directs drying of predetermined areas of substrates.

An alternative embodiment of the printer 100' is shown in FIG. 4. This embodiment is configured as the embodiment of FIG. 2A except the non-uniformly drying stage of FIG. 4 does not include a housing. Instead, the members to which the drying elements are mounted are attached to other structure in the printer 100" to enable the drying elements mounted to the underside of the members to dry the contiguous area that extends through the ink image in the process direction that is also aligned with the nip rollers 116. This embodiment does not hold air adjacent to the printed surface of the substrates, but the ambient air of the printer 100" does promote the drying of the remaining areas of the ink image sufficiently to pass the stacking criterion.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An aqueous ink printer comprising:

at least one printhead configured to eject drops of an aqueous ink;

a substrate transport system configured to move substrates past the at least one printhead to enable the at least one printhead to eject drops of the aqueous ink onto the substrates to form aqueous ink images on the substrates;

a member that extends across the substrate transport system in a cross-process direction, the member being positioned in a process direction at a location after the at least one printhead ejects drops of aqueous ink onto the substrates;

at least one roller that is mounted to the member and being positioned to contact the substrates on the substrate transport system after the at least one printhead has ejected drops of the aqueous ink onto the substrates, each roller in the at least one roller having a width in the cross-process direction that is less than a width of a single substrate in the cross-process direction and a total width of the rollers in the at least one roller is less than the width of the single substrate in the cross-process direction;

a first drying stage configured to dry the substrates uniformly across the width of the single substrate after the at least one printhead has formed aqueous ink images on the substrates and before the substrates reach the at least one roller on the member; and a second drying stage positioned to dry the substrates non-uniformly across the width of the single substrate after the substrates have passed through the first drying stage and before the substrates reach the at least one roller on the member, the second drying stage being configured with at least one member extending in the process direction so the at least one member aligns with the at least one roller and a plurality of drying elements mounted to the at least one member, the plurality of drying elements being aligned with the at least one roller in the process direction and no portion of the plurality of drying elements is opposite any portions of the substrates that do not contact the at least one roller so the plurality of drying elements directs drying only at predetermined portions of the substrates that contact the at least one roller so the plurality of drying elements dries the predetermined portions of the substrates contiguously in the process direction.

2. The aqueous ink printer of claim 1 wherein the drying elements are infrared radiators.

3. The aqueous ink printer of claim 1 wherein the drying elements are microwave radiators.

4. The aqueous ink printer of claim 1 wherein the drying elements are heat lamps.

5. The aqueous ink printer of claim 1 wherein the drying elements are convection heaters.

6. The aqueous ink printer of claim 1, the second drying stage further comprising:

a housing that encloses a volume of air adjacent to a surface of the substrates on which the aqueous ink images are formed.

7. The aqueous ink printer of claim 6 wherein the housing has a vent opening to enable evaporated water and solvent to exit the housing.

8. The aqueous ink printer of claim 7, the second drying stage further comprising:

a source of negative air pressure fluidically connected to the vent opening to pull evaporated water and solvent from the volume of air enclosed within the housing.

* * * * *